US006061226A

United States Patent [19]

Lelle et al.

[11] Patent Number: 6,061,226

[45] **Date of Patent: *May 9, 2000**

[54] RELAY CIRCUIT WITH CYCLICAL CONTROLLED CAPACITOR

[75] Inventors: Josef Lelle, Baden-Baden; Hans-Peter Bauer, Göcklingen; Alexander Meier, Bühlertal, all of Germany

[73] Assignee: Electrowatt Technology Innovation AG, Zug., Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 09/030,968

[22] Filed: Feb. 26, 1998

[30] Foreign Application Priority Data

Mar. 13, 1997 [CH] Switzerland ..... 0605/97
Jul. 7, 1997 [EP] European Pat. Off. ..... 97111431

[51] Int. Cl.[7] ..... H01H 47/32

[52] U.S. Cl. ..... 361/189; 361/155; 361/156

[58] Field of Search ..... 361/160, 152–156, 361/189, 190, 191, 194; 307/113–115

[56] References Cited

U.S. PATENT DOCUMENTS

| | | | |
|---|---|---|---|
| 3,896,346 | 7/1975 | Ule | 317/154 |
| 3,958,160 | 5/1976 | Niet et al. | 361/156 |
| 4,257,081 | 3/1981 | Sauer et al. | 361/156 |
| 4,271,450 | 6/1981 | Nishimura et al. | 361/155 |
| 4,862,866 | 9/1989 | Calfus | 123/490 |
| 5,532,526 | 7/1996 | Ricco et al. | 307/104 |

FOREIGN PATENT DOCUMENTS 1 047 524 11/1966 United Kingdom .

*Primary Examiner*—Jeffrey Gaffin
*Assistant Examiner*—Kim Huynh
*Attorney, Agent, or Firm*—Proskauer Rose LLP

[57] ABSTRACT

There is proposed a circuit for operation of at least one relay having an OFF-position and an ON-position, wherein the relay assumes the OFF-position in the event of a component failure of any element of the circuit. In the ON-position of the relay a capacitor, the relay and a voltage source are switched in a predetermined cycle in such a way that in a first time interval of the cycle the voltage source delivers a current which flows through the relay and partially charges up the capacitor and that in a second time interval of the cycle the capacitor delivers the current which flows through the relay, with the capacitor being partially discharged again.

5 Claims, 2 Drawing Sheets

RELAY CIRCUIT WITH CYCLICAL CONTROLLED CAPACITOR

BACKGROUND OF THE INVENTION

1. Field of the Invention

The invention relates to a relay circuit.

2. Description of the Prior Art

A previously proposed relay circuit has a relay which assumes the OFF-position in the event of a failure of a component of the circuit.

SUMMARY OF THE INVENTION

An object of the present invention is to provide a circuit which permits power-saving operation of a relay and with which a component failure results in the relay switching off.

According to the invention, there is provided a circuit comprising: a relay having an OFF-position and an ON-position, wherein the relay assumes the OFF-position in the event of a component failure of any element of the circuit; a voltage source; a capacitor associated with the relay; and switching means which in the ON-position of the relay switches the associated capacitor, the relay and the voltage source in a predetermined cycle in such a way that in a first time interval of the cycle the switching means delivers from the voltage source a current which flows through the relay and partially charges up the associated capacitor and that in a second time interval of the cycle the associated capacitor delivers the current which flows through the relay, in which case the associated capacitor is partially discharged again.

An illustrative embodiment of the invention operates as follows:

So that the relay switches from its OFF-position to the ON-position, the relay must be supplied with a current I which is greater than a minimum current $I_{min}$. After the switching operation the relay can be supplied with a holding current $I_H$ which is less than the minimum current $I_{min}$. In accordance with the invention therefore the relay is supplied with a current I(t), whose amplitude depends on time t. The current through the relay is delivered during a first time interval of a cycle by a voltage source, with the current charging up a capacitor. In that situation the amplitude of the current decreases with increasing charging voltage across the capacitor. Before the amplitude is smaller than the minimum necessary holding current $I_{H.min}$, the capacitor is partially discharged again during a second time interval of the cycle, with the discharging current flowing by way of the relay. The power requirement for holding the relay in the ON-position is reduced by virtue of the cyclically controlled charging and discharging of the capacitor. As soon as the circuit which produces the cyclic effect fails the relay drops into the OFF-position, as is necessary for example in relation to uses which are relevant in terms of safety.

BRIEF DESCRIPTION OF THE DRAWINGS

The above and other objects, features and advantages of the invention Will be apparent from the following detailed description of illustrative embodiments which is to be read in connection with the accompanying drawings, in which.

DESCRIPTION OF THE PREFERRED EMBODIMENTS

Figure 1:
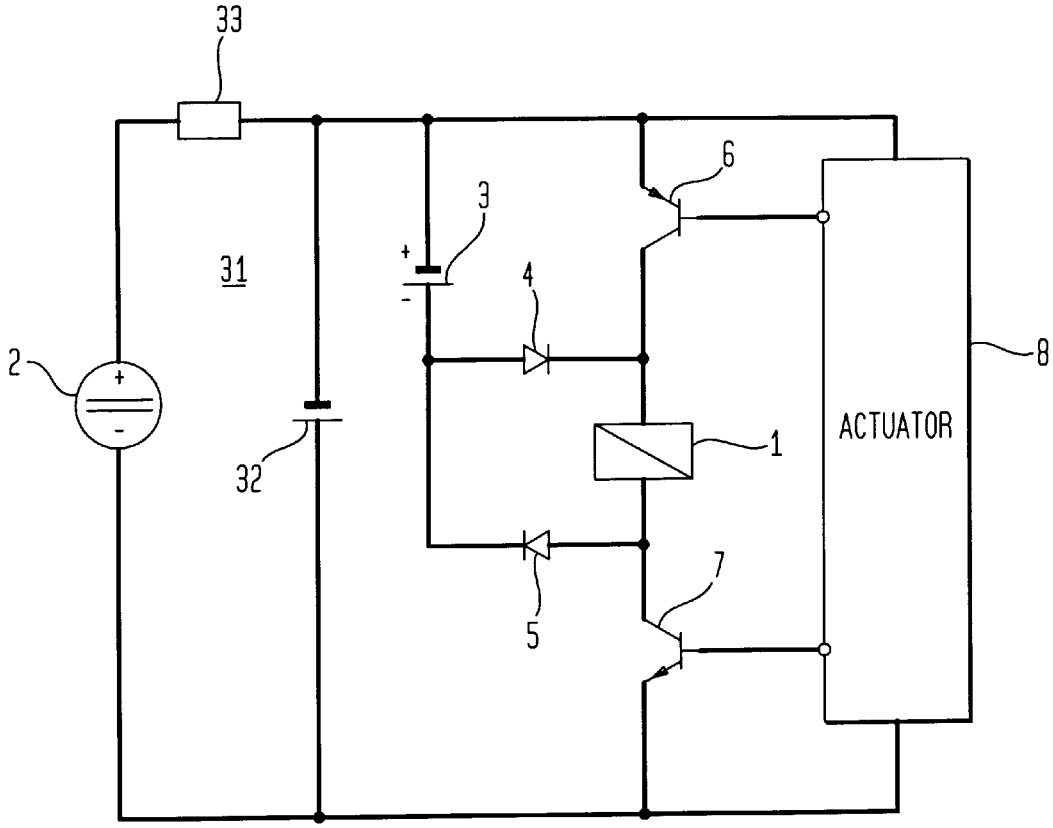
FIG. 1 shows a first example of a current-saving circuit for operation of a relay.

FIG. 1 shows a first example of an electronic circuit having a relay 1 which is supplied from a voltage source 2. The voltage source 2 delivers at the positive terminal a voltage which is positive relative to the negative terminal. The circuit further has a capacitor 3, two diodes 4 and 5, two switching transistors 6 and 7 and a circuit portion 8 for actuation of the switching transistors 6 and 7. The structure of the circuit including the relay 1, the source 2, the capacitor 3, the diodes 4, 5, the switching transistors 6, 7 and the actuator 8 can be directly seen from FIG. 1. When the relay 1 is in its OFF-position then the circuit portion 8 actuates the switching transistors 6 and 7 in such a way that both switching transistors 6, 7 or at least the switching transistor 7 are non-conducting. For switching the relay 1 from the OFF-position into the ON-position and for holding the relay 1 in the ON-position the circuit portion 8 alternately switches the switching transistor 6 or the switching transistor 7 into the conducting condition, that is to say the switching transistor 6 is non-conducting when the switching transistor 7 is conducting and vice-versa, in accordance with a predetermined cycle. When the circuit portion 8 switches the switching transistor 7 into the conducting condition then the voltage source 2 delivers a current $I_1$ which flows from the positive terminal of the voltage source 2 through the capacitor 3 and, by way of the diode 4, the relay 1 and the switching transistor 7 to the negative terminal of the voltage source 2. In that case the capacitor 3 is partially charged up, which in turn provides that the amplitude of the current $I_1(t)$ decreases with time t. Before the amplitude of the current $I_1(t)$ becomes too small to be able to hold the relay 1 in the ON-position the circuit portion 8 switches off the switching transistor 7 and switches the switching transistor 6 into the conducting condition. A current I?(t) then flows from the positive terminal of the capacitor 3 by way of the switching transistor 6, the relay 1 and the diode 5 to the negative terminal of the capacitor 3. The current $I_2(t)$ partially discharges the capacitor 3. Before the amplitude of the current $I_2(t)$ becomes too small to be able to hold the relay 1 in the ON-position the circuit portion 8 switches off the transistor 6 and again switches the transistor 7 into the conducting condition, whereupon the capacitor 3 is again charged up by the voltage source 2. That periodic charging and discharging of the capacitor 3 continues as long as the relay 1 is to be held in the ON-position.

Figure 2:
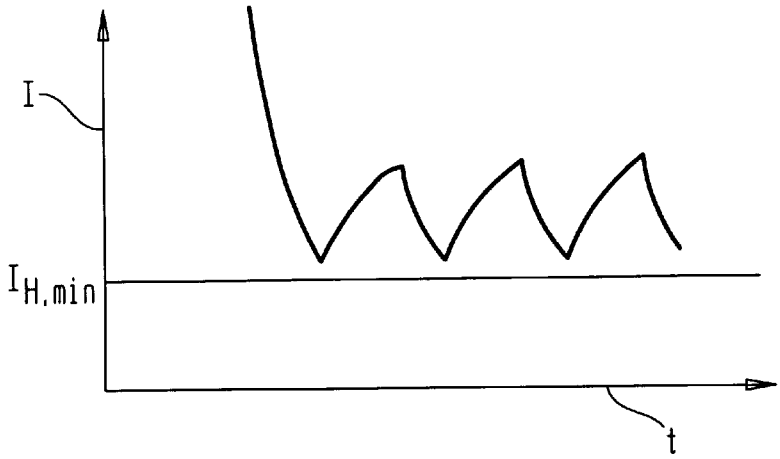
FIG. 2 shows the variation in relation to time of the current flowing through the relay.

FIG. 2 shows the variation in relation to time in the magnitude of the current I(t) which flows through the relay 1 in the ON-position (FIG. 1). The magnitude of the current I(t) is always greater than the minimum necessary holding current $I_{H.min}$. When the relay 1 is switched on a relatively large current :s required for a short time as the capacitor 3 is completely discharged and the entire supply voltage is applied to the relay 1. That current peak can be delivered by a buffer circuit 31 which comprises for example an additional capacitor 32 and a series resistor 33. The buffer capacitor 32 is charged up by the voltage source 2 over a comparatively long period of time. The voltage across the relay 1 is then reduced by the voltage across the capacitor 3. The circuit can thus also be considered as a so-called stepdown circuit. It affords the advantage that it is possible to use as the voltage source 2 a power pack which can deliver a comparatively high voltage of for example 54 V but only little current on average in respect of time. The stepdown conversion of the voltage also provides that power loss occurs only in the relay. The power for operation of the relay 1 is typically reduced to a quarter of the power in relation to conventional circuitry.

The invention further affords the advantage that the voltage source 2 is only loaded during the charging-up operation but not during discharging of the capacitor 3. If a short-circuit occurs at the switching transistor 7 the capacitor 3 is charged up and the current $I_1(t)$ continuously decreases. As soon as the current $I_1(t)$ is less than a holding current $I_H$ the relay 1 switches into the OFF-position. If a short-circuit occurs at the switching transistor 6 the capacitor 3 is then discharged and the current $I_1(t)$ continuously decreases. As soon as the current I(t) is less than a holding current $I_H$ the relay 1 switches into the OFF-position.

Figure 3:
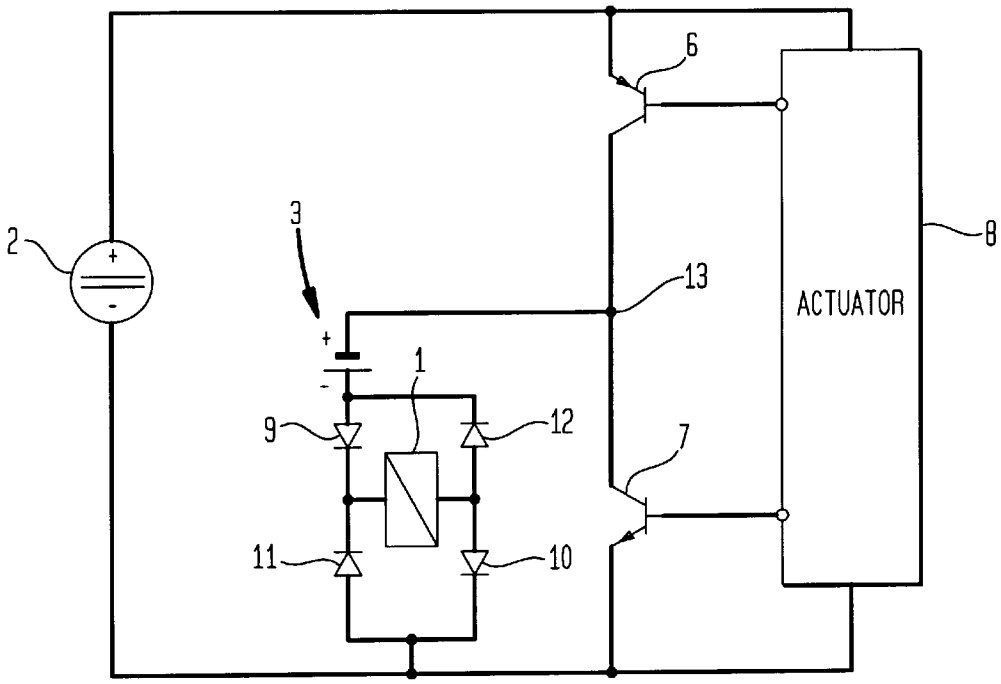
FIG. 3 shows a second example of a current-saving circuit for operation of the relay.

FIG. 3 shows a second example of an electronic circuit in which a short-circuit of both switching transistors 6 and 7 also causes the relay 1 to switch off. The switching transistors 6 and 7 are directly connected in series. The circuit has a bridge rectifier which is formed from four diodes 9–12 and in the bridge arm of which the relay 1 is arranged. The structure of circuit including the capacitor 3, the bridge rectifier and the relay 1 and the other components can be seen from FIG. 3. For the purposes of the relay 1 being held in its OFF-position the circuit portion 8 actuates the switching transistors 6 and 7 in such a way that both or one of the switching transistors 6, 7 are non-conducting. For switching the relay 1 from the OFF-position into the ON-position and for holding the relay 1 in the ON-position the circuit portion 8 again alternately switches the switching transistor 6 and the switching transistor 7 into the conducting condition, ir accordance with a predetermined cycle. When the switching transistor 6 conducts then the charging current $I_1(t)$ flows from the positive terminal of the voltage source 2 by way of the switching transistor 6 through the capacitor 3 and, by way of the diode 9, the relay 1 and the diode 10, to the negative terminal of the voltage source 2. When the switching transistor 7 conducts then the discharging current $I_1(t)$ flows from the positive terminal of the capacitor 3 by way of the switching transistor 7, the diode 11, the relay 1 and the diode 12 to the negative terminal of the capacitor 3.

If the switching transistor 6 is permanently conducting due to a component failure then the charging current $I_1(t)$ firstly flows. As in that situation the capacitor 3 charges up, the amplitude of the charging current $I_1(t)$ continuously decreases. As soon as the current $I_1(t)$ is less than the minimum necessary holding current $I_{H.min}$ the relay 1 is released and remains in its OFF-position. If the switching transistor 7 permanently conducts because of a component failure, the capacitor 3 is discharged until the relay 1 is again released because of an excessively low current $I_2(t)$ and remains in its OFF-position. If both switching transistors 6 and 7 are destroyed for example as a result of over-voltage and are permanently conducting, then the voltage source 2 is short-circuited and the relay 1 goes into its OFF-position.

When considering the situation in a different fashion, it could also be said that in the ON-position of the relay an alternating current is produced at the connecting point 13 of the two switching transistors 6 and 7, and that alternating current is fed via the capacitor 3 to a bridge rectifier formed by the diodes 9–12, rectified and fed to relay 1. In contrast in the OFF-position of the relay 1 a direct voltage occurs at the connecting point 13 and the capacitor 3 prevents the direct current from flowing to the relay 1.

Figure 4:
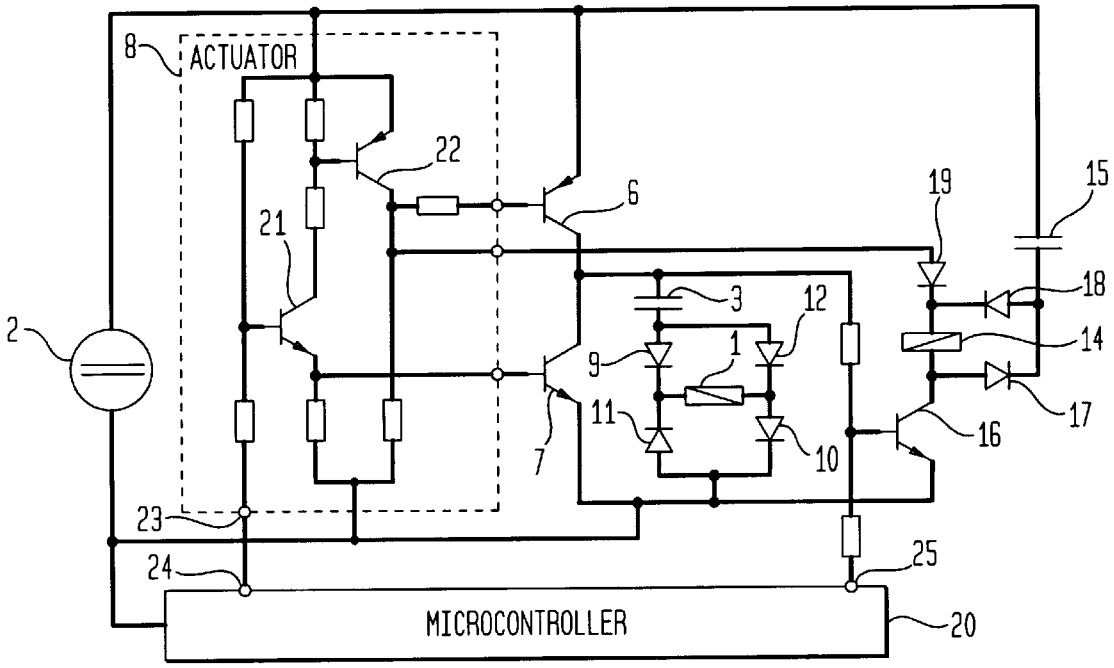
FIG. 4 shows an example of a current-saving circuit for operation of a plurality of relays

FIG. 4 shows an example of a circuit which is based on the circuit shown in FIG. 3 and in which a further relay 14 is arranged in a kind of cascade configuration. Associated with the relay 14 are a capacitor 15, a switching transistor 16 and diodes 17–19. The circuit is controlled by a microcontroller 20. The actuator circuit portion 8 has two transistors 21 and 22 and various resistors, a control input 23, two outputs for actuation of the switching transistors 6, 7 and a further output which is connected to the relay 14 by way of the diode 19 The structure of the circuit can be seen from FIG. 4.

The microcontroller 20 dynamically actuates the relay 1 by way of an output 24 connected to the control input 23 of the circuit portion 8: as long as the microcontroller 20 carries at the output 24 a negative static potential which is less than the potential of the negative terminal of the voltage source 2, the switching transistor 7 is in a non-conducting condition and the relay 1 is in its OFF-position. As soon as the microcontroller 20 provides at the output 24 a rectangular signal with the two voltage levels of 0V/−5V and the correct clock frequency, the transistors 7, 21, 22 or 6 alternately conduct and the relay 1 switches into the ON-position.

The microcontroller 20 statically actuates the relay 14 by way of an output 25. When a negative voltage of −5V occurs at the output 25 of the microcontroller 20 the transistor 16 is then in a non-conducting condition and the relay 14 remains in the OFF-position. If the microcontroller 20 carries at the output 25 the potential of ground of 0V then the transistor 16 conducts whenever the switching transistor 6 is also conducting and the relay 14 goes into the ON-position.

The circuit has the particularity that the relay 14 can be switched into its ON-position only when the relay 1 is in its ON-position. As soon therefore as a component failure causes the relay 1 to go into its OFF-position the relay 14 also switches into the OFF-position.

The possibility of adopting a cascade arrangement for the relay 14 and possibly further relays affords the advantage that the circuit portion 8 is also used for those additional relays so that the power consumption for actuation of the relays can be kept at a very low level. In particular a simple power pack can be used as the voltage source 2 because of the current-saving mode of actuation of the relays 1.

Such circuits are suitable for use in automatic burner control units where at least two safety relays are connected in series in regular operation.

The power consumption in operation of the relay could also be minimised by briefly switching on in series with the voltage source, a second voltage source, for switching on the relay. Then, when the relay is switched on, with double the voltage, twice the current flows, that is to say four times the power.

The circuits of FIGS. 3 and 4 may comprise a buffer circuit 31 as shown in FIG. 1.

Although illustrative embodiments of the invention have been described in detail herein with reference to the accompanying drawings, it is to be understood that the invention is not limited to those precise embodiments, and that various changes and modifications can be effected therein by one skilled in the art without departing from the scope and spirit of the invention as defined by the appended claims.

We claim:

1. A circuit comprising:

a relay having an OFF-position and an ON-position, wherein the relay assumes the OFF-position in the event of a component failure of any element of the circuit and the relay holds the ON-position when supplied with at least a predetermined minimum current;

a voltage source;

a capacitor associated with the relay; and switching means which in the ON-position of the relay connects the associated capacitor, the relay and the voltage source in a predetermined cycle in such a way that in a first time interval of the cycle the switching means delivers from the voltage source a current which flows through the relay and partially charges up the associated capacitor and that in a second time interval of the cycle the associated capacitor delivers the current which flows through the relay, in which case the associated capacitor is partially discharged, wherein the predetermined minimum current for holding the relay in the ON-position is reduced due at least to the predetermined cycle of and discharging the associated capacitor.

2. A circuit according to claim 1, comprising a further relay, a further capacitor associated with the further relay, and further switching means which cooperate with the said first-mentioned switching means in the said predetermined cycle such that in the first time interval the switching means deliver from the voltage source a current which flows through the further relay and charges up the further capacitor, and in the second time interval the further capacitor delivers the current which flows through the further relay.

3. A circuit according to claim 2, further comprising a controller for selectively enabling the further switching means.

4. A circuit according to claim 1, where the voltage source further comprises a buffer circuit for delivering a current which is sufficient to switch the relay from its OFF-position to its ON-position.

5. A circuit according to claim 4, wherein the buffer circuit comprises a capacitor.

* * * * *